US006076603A

United States Patent [19]

Perrin

[11] Patent Number: 6,076,603

[45] Date of Patent: Jun. 20, 2000

[54] METHOD FOR REMOVAL AND TREATMENT OF PARAFFIN

[76] Inventor: Perry Perrin, P.O. Box 206, Galliano, La. 70354

[21] Appl. No.: 09/124,714

[22] Filed: Jul. 30, 1998

Related U.S. Application Data

[60] Provisional application No. 60/054,231, Jul. 30, 1997.

[51] Int. Cl.[7] ..... E21B 37/04

[52] U.S. Cl. ..... 166/304; 166/170; 166/311

[58] Field of Search ..... 166/302, 304, 166/311, 57, 75.15, 170, 75.12, 75.11

[56] References Cited

U.S. PATENT DOCUMENTS

| | | | |
|---|---|---|---|
| 1,439,560 | 12/1922 | Lee | 166/303 |
| 3,438,444 | 4/1969 | Wilkerson | 166/304 |
| 4,037,660 | 7/1977 | Newsom et al. | 166/302 |
| 4,224,993 | 9/1980 | Huckaby | 166/325 |
| 4,830,111 | 5/1989 | Jenkins et al. | 166/303 |
| 4,836,286 | 6/1989 | Edwards | 166/304 |
| 4,911,240 | 3/1990 | Haney et al. | 166/304 |
| 5,168,929 | 12/1992 | Galloway | 166/304 |
| 5,247,994 | 9/1993 | Nenniger | 166/303 |
| 5,641,022 | 6/1997 | King | 166/303 |

*Primary Examiner*—Michael Mar
*Assistant Examiner*—E L Gort
*Attorney, Agent, or Firm*—Garvey, Smith, Nehrbass & Doody, L.L.C.

[57] ABSTRACT

A method of removing paraffin from a wellbore at a well site having production tanks includes the following steps of heating a scraper to at least about the melting temperature of paraffin; lowering the scraper into a wellbore and below a paraffin accumulation; pulling the scraper and paraffin upward into a lubricator means above a production tree; and using hot fluid and by manipulating valves, causing the paraffin to move from the lubricator means into a tank.

2 Claims, 1 Drawing Sheet

METHOD FOR REMOVAL AND TREATMENT OF PARAFFIN

CROSS-REFERENCE TO RELATED APPLICATIONS

Priority of U.S. Provisional Patent Application Ser. No. 60/054,231, filed Jul. 30, 1997, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to paraffin removal. More particularly, the present invention relates to apparatus for and methods of removing paraffin accumulations from oil wells.

2. General Background of the Invention

Some petroleum deposits contain paraffin therein. At the elevated temperatures underground, this paraffin is a liquid and flows easily. When, however, the petroleum travels through a well bore toward the surface, the petroleum and paraffin cool off. At some point below the surface, the temperature is usually low enough that the paraffin solidifies in the well bore. The solidified paraffin slows down production of oil from the well bore, and thus it is periodically cleaned from the well bore.

A common way to clean paraffin deposits is to drop a scraper on a wireline into the well bore below the paraffin deposit, and then pull the scraper upward, scraping off paraffin as the scraper approaches the surface. The paraffin is usually then sent down the production flow line, moving the paraffin problem from downhole to the production flow line. The production flow line is then treated with hot oil to clean the paraffin out of it.

Flowlines and wellbores are also sometimes treated with chemicals to help combat the paraffin problem. These chemicals are often hazardous.

BRIEF SUMMARY OF THE INVENTION

The apparatus of the present invention solves the problems confronted in the art in a simple and straightforward manner. What is provided is apparatus for and a method of removing paraffin from oil wells without simply transferring the paraffin problem to the production flow line.

Simply stated, the present invention comprises a method of scraping paraffin from an oil well bore and transferring it to a container where it can be processed. The present invention also comprises apparatus to carry out the method.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

Figure 1:
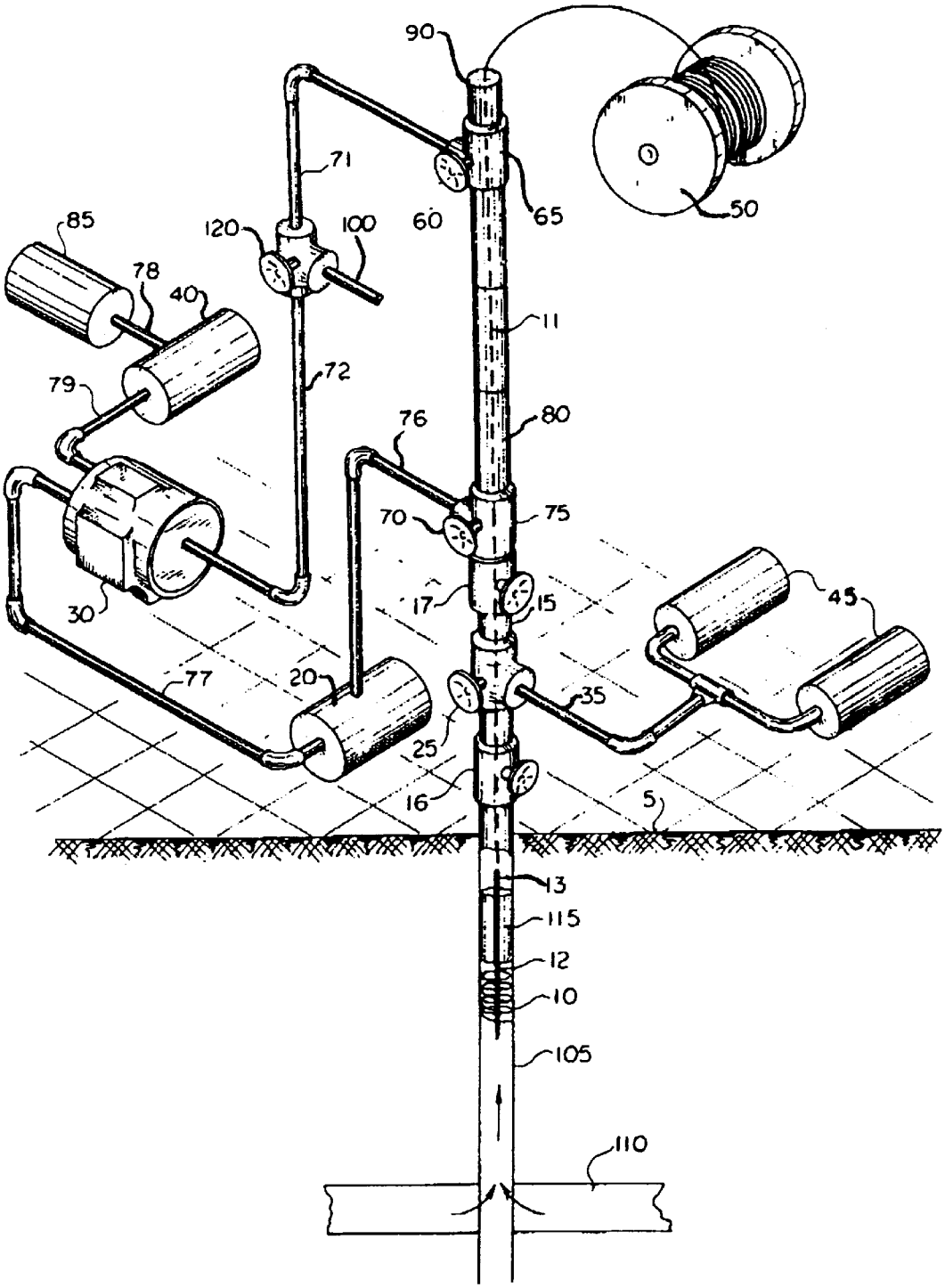
FIG. 1 is a perspective view of the preferred embodiment of the apparatus of the present invention.

PARTS LIST:
The following is a list of parts which could be used in the present invention.

| | |
|---|---|
| 10 | scraper - Global Oil Tool paraffin wire scratcher |
| 11 | wireline (such as a slick line) |
| 12 | wireline jar(s) (Spang, e.g.) |
| 13 | weight bar(s) (15'–25', e.g.) |
| 15 | Christmas tree |
| 20 | tank - 60 barrel treatment tank |
| 25 | swab valve |
| 30 | pump - Halliburton 1.5 inch, 30–40 gallons per minute |
| 35 | flow line |
| 40 | heater coil - Keyway |
| 45 | tank battery |
| 50 | wireline spool - Gulf Coast Manufacturing |
| 60 | upper valve - check valve - made by WKM |
| 65 | Pump-in sub - Bowen part no. 80591 (2.5 inch inner diameter, 5,000 psi working pressure, 12685 union, 2" LP Box side outlet) |
| 70 | lower valve - lubricator wing valve - made by Halliburton |
| 71 | flow line |
| 72 | flow line |
| 75 | Pump-in sub - Bowen part no. 80591 (2.5 inch inner diameter, 5,000 psi working pressure, 12685 union, 2" LP Box side outlet) made by Bowen Tools Division of IRI International Corp., Houston, TX |
| 76 | flow line |
| 77 | flow line |
| 78 | flow line |
| 79 | flow line |
| 80 | lubricator - made by Global Oil Tools - for cleaning tools - it needs to be long enough to hold scraper |
| 85 | water source |
| 90 | stuffing box - Bowen model no. 27490 |
| 100 | alternative flow line to allow emptying of tank 20 |
| 105 | well bore |
| 110 | petroleum reservoir |
| 115 | paraffin accumulation in well bore 105 (below this the well bore is clean because it is too hot for the paraffin to accumulate - above this the well bore is clean because all of the paraffin has already accumulated in this zone) |
| 120 | valve |

DETAILED DESCRIPTION OF THE INVENTION

FIG. 1 is a perspective view showing the apparatus of the present invention in use on site.

FIG. 1 shows a well bore 105 extending from an underground petroleum reservoir 110 to the surface 5. Paraffin accumulation 115 in well bore 105 occurs where the paraffin cools off enough to solidify. Below this accumulation 115 the well bore 105 is clean because it is too hot for the paraffin to accumulate—above this accumulation 115 the well bore 105 is clean because all of the paraffin has already accumulated in this zone.

At the top of the well bore 105 is a Christmas tree 15 including cut-off valves 16 and 17 and a swab valve 25 which regulates the flow of petroleum to a flow line 35. The flow line 35 leads to a tank battery 45.

The apparatus of the present invention includes a paraffin wire scratcher 10 attached to a wireline 11. The wireline 11 is attached to a spool 50. The wireline 11 extends through a stuffing box 90 into a sub including a lubricator 80, through the Christmas tree 15, down into the wellbore 105. Between the scraper 10 and the wireline 11 can be interposed one or more wireline jars 12 and one or more weight bars 13 to facilitate scraping of the wellbore with scraper 10. The sub should to be long enough to hold the scraper 10, wireline jar(s) 12, and weight bar(s) 13 so that the scraper can be cleaned with hot fluid (such as hot oil or steam).

A tank 20 is connected to a valve 70 and a pump-in sub 75 with a flow line 76.

A pump 30 is connected to the tank 20 with a flow line 77. A flow line 79 connects a heater coil 40 or other heat source to the pump 30. The heater coil 40 is connected to a source 85 of water or other fluid via flow line 78. Flow lines 72 and 71 connect pump 30 to the sub including lubricator 80 through a valve 60 and a pump-in sub 65.

An alternative flow line 100 to allow emptying of tank 20 is connected to flow line 72 with a valve 120.

For ease of transportation, the apparatus of the present invention (and particularly tank 20, pump 30, source 85, heat source 40, and connecting flow lines) could be loaded onto a barge or a flat bed truck, or it could be skid-mounted.

In operation, the pump-in sub 75 is attached to the Christmas tree 15 at cut-off valve 17. Valve 25 is manipulated to stop flow from going from the Christmas tree 15 into the flow line 35. The scraper 10 is placed in the lubricator 80. With valve 17 closed, steam or other hot fluid is run through lubricator 80, heating the scraper. The valves 17 and 16 are then opened, and the scraper 10 is lowered past the paraffin accumulation 115 in the wellbore 105. The scraper 10 is then pulled upward, scraping some of the paraffin from the paraffin accumulation 115 upward into the lubricator 80. The valve 17 is closed again, and steam or other hot fluid is then pumped by the pump 30 from the heat source 40 from the fluid source 85. The hot fluid melts the paraffin and causes it to flow into the tank 20, where it can be stored or, if there too much to fit in the tank 20, it can be pumped out with the pump 30 through flow lines 77, 72, valve 120, and flow line 100 to another location. The hot fluid both cleans the scraper 10 and heats it up, making it more efficient in scraping paraffin from the wellbore 105.

After all paraffin is scraped from the paraffin accumulation 115 into the tank 20, the well can be allowed to flow into the tank 20 for a sufficient time to allow any paraffin which might have fallen into the wellbore 105 to flow into the tank 20.

The paraffin can be treated or otherwise processed after it enters tank 20.

The scraper 10 can be heated to a temperature of, for example about 200 degrees F.

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

I claim:

1. A method of removing paraffin from a wellbore at a well site having production tanks comprising the following steps:

(a) heating a scraper to at least about the melting temperature of paraffin;

(b) lowering the scraper into a wellbore and below a paraffin accumulation;

(c) pulling the scraper and paraffin upward into a lubricator means above a production tree;

(d) using hot fluid and by manipulating valves, causing the paraffin to move from the lubricator means into a tank means.

2. The method of claim 1, wherein the tank means is separate from the production tanks at the well site.

* * * * *